US005842109A

United States Patent [19]

Akpan et al.

[11] Patent Number: 5,842,109

[45] Date of Patent: Nov. 24, 1998

[54] METHOD FOR PRODUCING POWDER METAL CYLINDER BORE LINERS

[75] Inventors: Edward Akpan, Novi; John E. Brevick, Livonia, both of Mich.

[73] Assignee: Ford Global Technologies, Inc., Dearborn, Mich.

[21] Appl. No.: 678,311

[22] Filed: Jul. 11, 1996

[51] Int. Cl.[6] ..... B22F 3/12

[52] U.S. Cl. ..... 419/38; 419/6

[58] Field of Search ..... 419/38, 6

[56] References Cited

U.S. PATENT DOCUMENTS

| | | | |
|---|---|---|---|
| 3,536,123 | 10/1970 | Isumi . | |
| 3,903,951 | 9/1975 | Kaneko et al. . | |
| 4,419,971 | 12/1983 | Nakamura et al. . | |
| 4,537,167 | 8/1985 | Eudier et al. . | |
| 4,562,799 | 1/1986 | Woods et al. | 123/193 C |
| 4,630,345 | 12/1986 | Lutz | 29/156.4 WL |
| 4,650,644 | 3/1987 | Huret et al. | 419/11 |
| 4,655,610 | 4/1987 | Al-Jaroudi | 384/13 |
| 4,936,270 | 6/1990 | Ushio et al. | 123/193 |
| 4,959,276 | 9/1990 | Hagiwara et al. | 428/614 |
| 5,164,256 | 11/1992 | Sato et al. | 428/304.4 |
| 5,408,964 | 4/1995 | Rao | 123/193.2 |
| 5,445,790 | 8/1995 | Hu et al. | 419/44 |
| 5,469,821 | 11/1995 | Gosch | 123/193.2 |
| 5,482,637 | 1/1996 | Rao et al. | 252/29 |
| 5,482,671 | 1/1996 | Weber | 419/36 |
| 5,484,662 | 1/1996 | Rao | 428/553 |
| 5,566,450 | 10/1996 | Rao et al. | 29/888.061 |
| 5,749,331 | 5/1998 | Pettersson et al. | 123/193.2 |

FOREIGN PATENT DOCUMENTS 2273967 6/1994 United Kingdom .

*Primary Examiner*—Ngoclan Mai

*Attorney, Agent, or Firm*—Joseph W. Malleck, Esq.; Roger L. May, Esq.

[57] ABSTRACT

A method for producing powder metal cylinder bore liners for an internal combustion engine includes the steps of loading a powder metal mixture into a die cavity of a die, compacting the powder metal mixture in the die cavity using uniaxial pressure from the die and forming the powder metal cylinder bore liner, and sintering the powder metal cylinder bore liner.

20 Claims, 4 Drawing Sheets

FIG 3
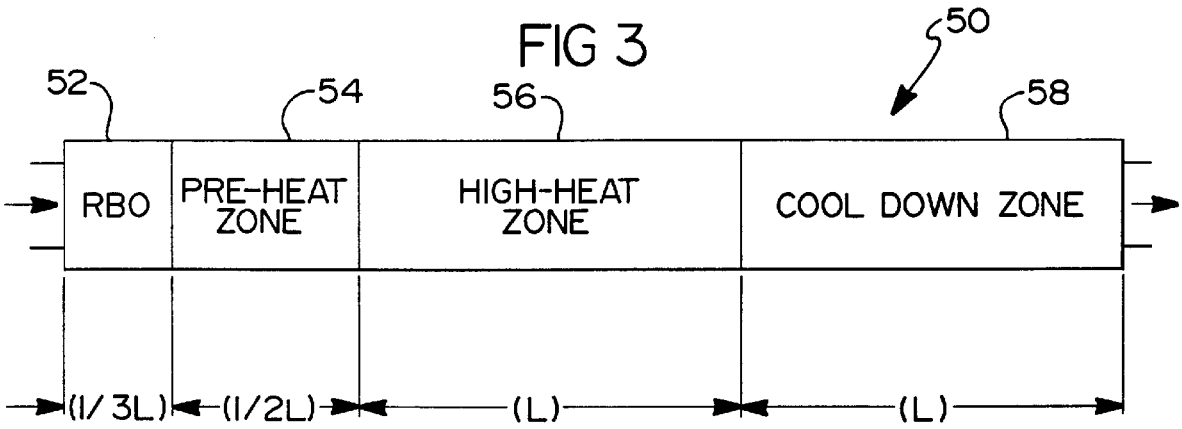
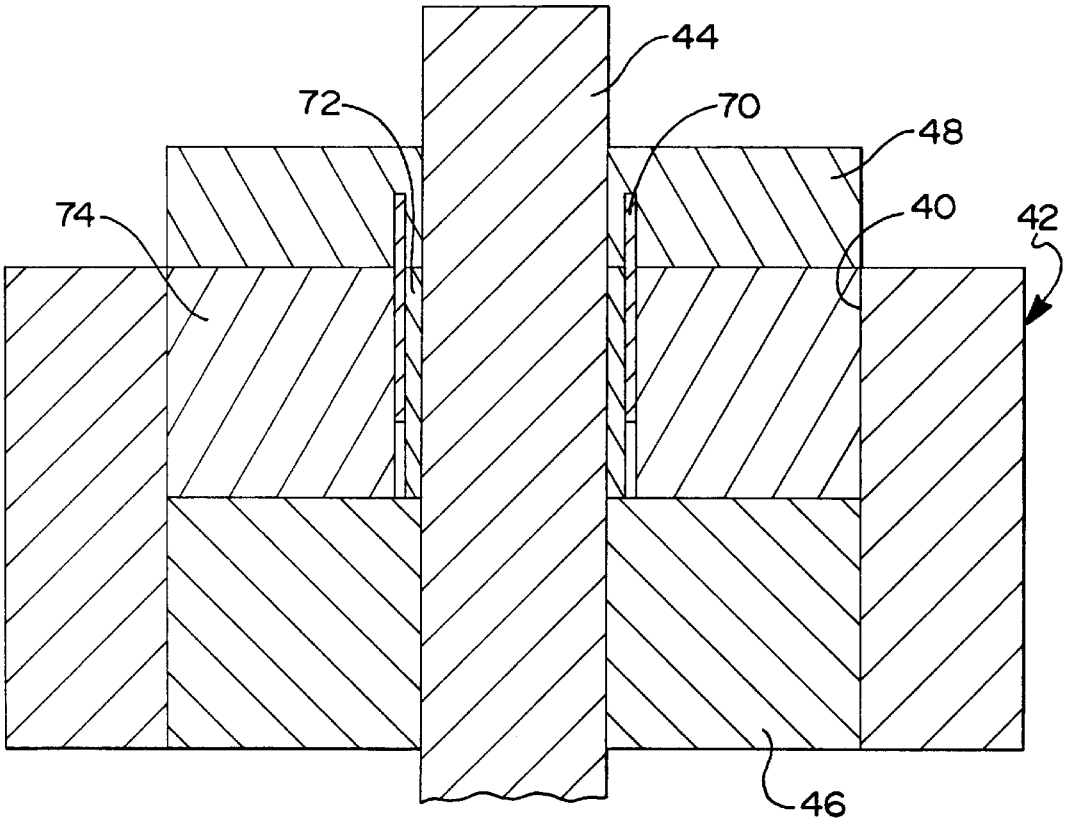
FIG 6

METHOD FOR PRODUCING POWDER METAL CYLINDER BORE LINERS

BACKGROUND OF THE INVENTION

1. Field of the Invention

The present invention relates generally to cylinder bore liners for internal combustion engines and, more specifically, to a method for producing powder metal cylinder bore liners for an internal combustion engine.

2. Description of the Related Art

It is known to provide cylinder bore sleeves/liners for an internal combustion engine. Typically, the liners are made with cast iron materials. These liners are centrifically cast into tubes which are subsequently machined and cut to desired dimensions. The liners have an inside diameter or surface which is honed for oil retention and flow.

Although the above cast iron cylinder bore liners have worked well, they suffer from the disadvantage that the liners are relatively expensive and time intensive to machine, resulting in relatively low volume production. Also, the cast iron cylinder bore liners are relatively high in weight and scrap material from machining.

It is also known to provide powder metal cylinder bore liners for an internal combustion engine. Typically, the liners are made with powder metal materials. These liners are produced by cold isostatic compaction which provides equal pressure in all directions during compaction.

Although the above powder metal cylinder bore liners have worked well, they suffer from the disadvantage that the cold isostatic compaction process and associated equipment are relatively expensive. Therefore, there is a need in the art to produce powder metal cylinder bore liners that are relatively inexpensive to produce and have high volume production.

SUMMARY OF THE INVENTION

Accordingly, the present invention is a method for producing powder metal cylinder bore liners for an internal combustion engine. The method includes the steps of loading a powder metal mixture into a die cavity of a die. The method also includes the steps of compacting the powder metal mixture in the die cavity using uniaxial pressure from the die and forming the powder metal cylinder bore liner. The method further includes the step of sintering the powder metal cylinder bore liner.

One feature of the present invention is that a method is provided for producing powder metal cylinder bore liners for an internal combustion engine. Another feature of the present invention is that the method is relatively inexpensive compared to conventional processes and results in a weight reduction of the liners. Yet another feature of the present invention is that the method produces liners having a near net shape without extensive post sintering machinery to achieve desired dimensions. Still another feature of the present invention is that the method lends itself to higher volume production and higher tensile strengths by adjusting the powder chemistry. A further feature of the present invention is that the method allows the liners to be easily heat treated to improve wear characteristics and achieve complex surface geometries such as grooves. A still further feature of the present invention is that the method allows a broad spectrum of materials to be used to produce the liner and the powdered materials can be easily recycled by atomization and reduction technologies. Yet a further feature of the present invention is that the method allows the liners to be produced having a multiple piece construction, resulting in a liner with uniform density and allows smaller presses to be used. Another feature of the present invention is that the method allows a composite liner to be produced having a multiple piece construction.

Other features and advantages of the present invention will be readily appreciated as the same becomes better understood after reading the subsequent description taken in conjunction with the accompanying drawings.

BRIEF DESCRIPTION OF THE DRAWINGS

FIG. 3 is a diagrammatic view of a multi-zone furnace for producing the cylinder bore liner of FIG. 1.

FIG. 6 is a fragmentary elevational view of a die for producing the cylinder bore liner of FIG. 5.

DESCRIPTION OF THE PREFERRED EMBODIMENT(S)

Figure 1:
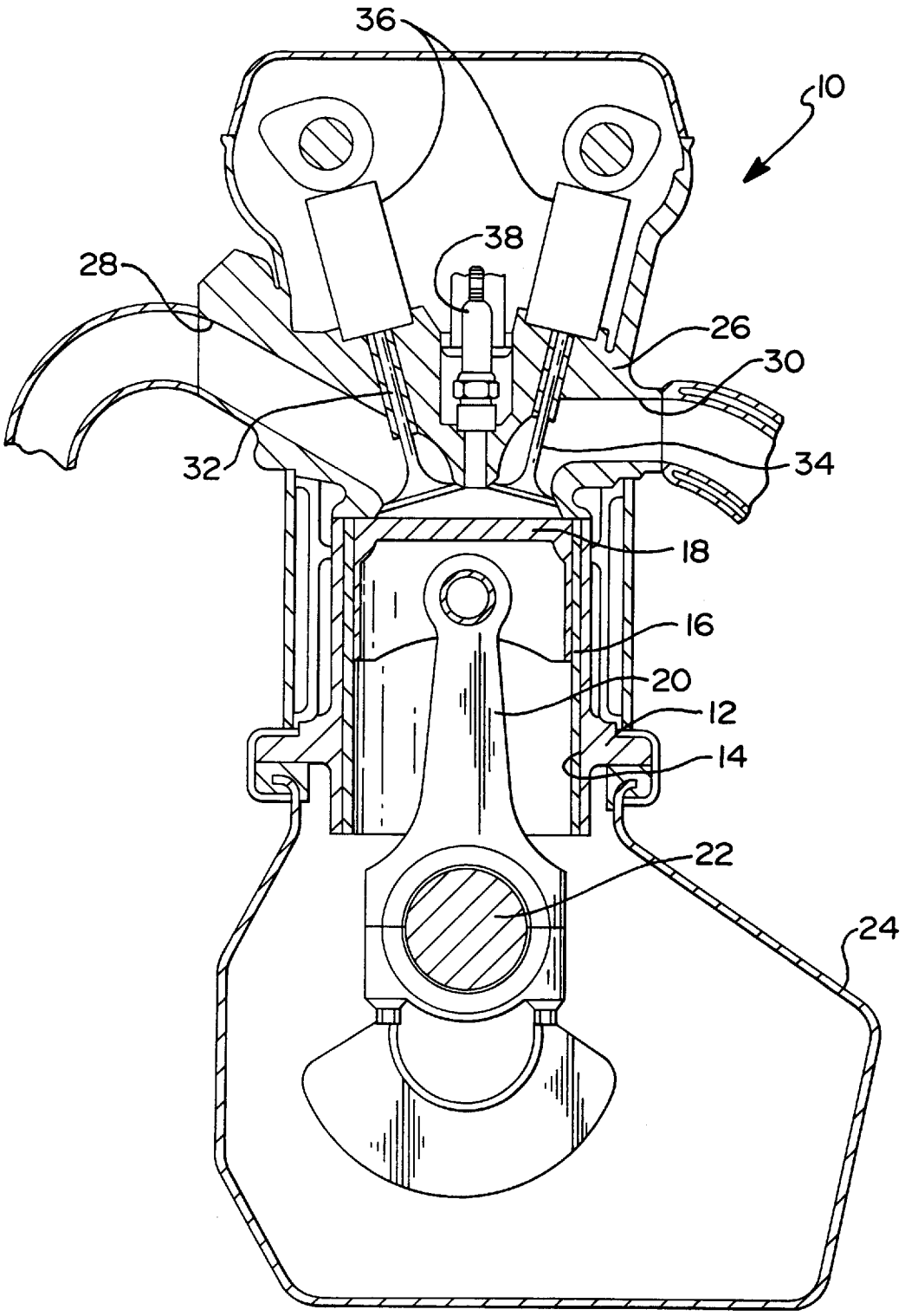
FIG. 1 is a fragmentary elevational view of an internal combustion engine having a cylinder bore liner produced by a method, according to the present invention.

Referring to FIG. 1, an internal combustion engine 10 is illustrated. The internal combustion engine 10 includes an engine block 12 having at least one cylinder bore 14. The internal combustion engine 10 also includes a cylinder bore liner 16, according to the present invention, disposed within the cylinder bore 14 and a piston 18 disposed within the cylinder bore liner 16. The internal combustion engine 10 includes a connecting rod 20 connected to the piston 18 and a crankshaft 22 connected to the connecting rod 20 and rotating within a crankcase 24.

The internal combustion engine 10 further includes a head 26 attached to the engine block 12. The head 26 includes intake passages 28 and exhaust passages 30 opened and closed by intake valves 32 and exhaust valves 34, respectively, and operated by a valve train 36. The head 26 also includes a spark igniter 38 for igniting combustible gases in a combustion chamber between the piston 18 and head 26. It should be appreciated that liquid lubricant such as oil is drawn from the crankcase 24 and splashed within the interior of the engine block 12 to lubricate and bathe the piston 18 during its reciprocal movement therein.

The cylinder bore liner 16 is made of a powder metal mixture. The powder metal mixture is a ferrous grade material according to Standard No. 35 of the Metal Powders Industries Federation (MPIF) . For example, the ferrous grade material may be FCO208 of MPIF. optionally, organic lubricants such as Acrawax and Kenolube may be added to the powder metal mixture to reduce die wall friction. Also, Sulfide may be added to the powder metal mixture to enhance ancillary machining after sintering to be described. The average particle size of the powder metal mixture is about sixty-six microns. It should be appreciated that non-ferrous materials such as aluminum, stainless steel and iron-nickel type powder metal alloys may be used for the powder metal mixture.

Figure 2:
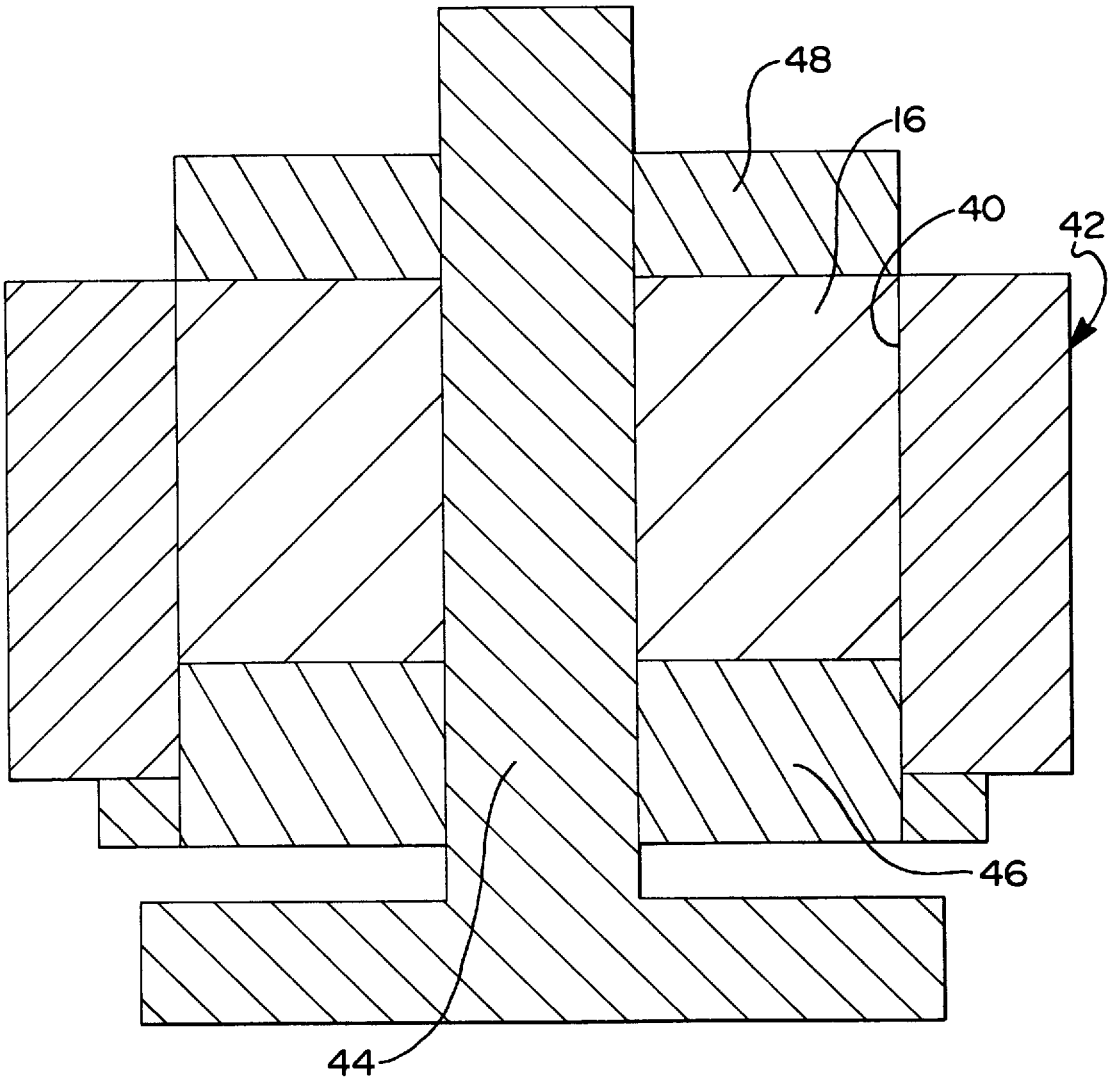
FIG. 2 is a fragmentary elevational view of a die for producing the cylinder bore liner of FIG. 1.

A method, according to the present invention, is used for producing the powder metal cylinder bore liner 16. In one embodiment, the method uses uniaxial pressure to make a one-piece powder metal cylinder bore liner 16. The method includes the step of loading or transferring the powder metal mixture into a die cavity 40 of a die, generally indicated at 42 in FIG. 2. The die 42 is secured to a multi-platen press (not shown) such as a six hundred ton press. The die 42 includes an independent core rod 44 extending through the die cavity 40 and around which the cylinder bore liner 16 is formed. The core rod 44 is attached to one platen (not shown) of the multi-platen press. The die 42 includes a movable bottom punch 46 at a lower or bottom end of the die cavity 40 and attached to another platen (not shown) of the multi-platen press. The die 42 also includes a movable top punch 48 at an upper or top end of the die cavity 40 and attached to yet another platen (not shown) of the multi-platen press. Preferably, the outer surface of the core rod 44 and wall surface of the die 42 are polished to approximately 0.0001 inches to reduce friction and force to eject the formed cylinder bore liner 16 from the die cavity 40. The die 42 is formed of carbide or alloy materials. It should be appreciated that the multi-platen press has independent control and balanced platens in order to reduce any shearing effect during compaction to be described.

The method also includes the step of compacting the powder metal mixture in the die cavity 40 using uniaxial pressure from the die 42 and forming the cylinder bore liner 16. The die 42 is held relatively stationary and the bottom punch 46 is moved toward the top punch 48 to produce uniaxial pressure to press the powder metal mixture. The powder metal mixture is pressed with a force sufficient to form a cylinder bore liner 16 with about eight-five percent (85%) to about ninety percent (90%) of its parent material's theoretical density after sintering to be described. For example, thirty-two (32) to forty (40) tons per square inch of compacting pressure will form cylinder bore liners 16 with densities of about 6.8 grams per cubic inch, which is approximately eighty-five percent (85%) of the theoretical density of the material. Since the pressure-density relationship is predictable, sufficient pressure should be applied to ensure acceptable density at the center and edges of the cylinder bore liner 16. It should be appreciated that, in some applications where lower mechanical properties would suffice, lower compacting pressures and lower densities may be used. It should also be appreciated that the size of the die cavity 40 may be limited to promote stiffness in the cylinder bore liner 16. It should further be appreciated that the powder size distribution of the powder metal mixture must be selected so as to enhance compaction by balancing the number of fine particles desirable for sintering against larger particles desirable for compaction.

After compacting the powder metal mixture and forming the cylinder bore liner 16, the method includes the step of ejecting the cylinder bore liner 16 from the die cavity 40. The top punch 48 is held down to slide the cylinder bore liner 16 from the die cavity 40 in a series of steps or sections as the die 42 moves toward the bottom punch 46 to allow ejected sections of the cylinder bore liner 16 to stabilize to ambient conditions. When the top punch 48 is held down, density gradients in the cylinder bore liner 16 and any tendency toward the formation of ejection cracks in the cylinder bore liner 16 are minimized. It should be appreciated that the compacted powder metal cylinder bore liner 16 is a brittle briquette which must be sintered to develop strength.

The method includes the step of sintering the compacted powder metal cylinder bore liner 16. The cylinder bore liner 16 is sintered in a multi-zone furnace, generally indicated at 50 in FIG. 3. The multi-zone furnace 50 has a plurality of zones along its longitudinal length at various temperatures. At an inlet end, the multi-zone furnace 50 has a rapid burn off (REO) zone 52 to remove any organic lubricant from the cylinder bore liner 16. The RBO zone 52 is at a temperature from about 1400° F. to about 1450° F. and a high humidity level from about eighty-five percent (85%) and above. The cylinder bore liner 16 moves through the RBO zone 52 at a speed of about two inches per minute. The high humidity level acts as a catalyst to dissolve the organic lubricant from the compacted powder metal cylinder bore liner 16 and a neutral gas such as nitrogen or argon is used to sweep the decomposed gases out of the RBO zone 52 of the multi-zone furnace 50. It should be appreciated that failure to effectively delude the compact, prior to the beginning of high heat sintering will retard the sintering process.

After the RBO zone 52, the multi-zone furnace 50 has a pre-heat zone 54 to gradually ramp up the cylinder bore liner 16 to the sintering temperature. The pre-heat zone 54 is at a temperature of about 1700° F. The cylinder bore liner 16 moves through the pre-heat zone 54 in a time period from about thirty to about forty minutes. A neutral atmosphere of a neutral gas such as nitrogen ($N_2$) is provided in the pre-heat zone 54.

After the pre-heat zone 54, the multi-zone furnace 50 has a high-heat zone 56 to sinter the cylinder bore liner 16. The high-heat zone 56 is at a temperature from about 2050° F. to about 2100° F. The high-heat zone has a low dewpoint of about −40° F. The cylinder bore liner 16 moves through the high-heat zone 56 from about forty-five minutes to about sixty minutes. An atmosphere of hydrogen ($H_2$) is provided in the high-heat zone 56 although a neutral gas such as nitrogen ($N_2$) may be used. It should be appreciated that any atmosphere which promotes carburizing or decarburizing should be avoided.

After the high-heat zone 56, the multi-zone furnace 50 has a cool down zone 58 to cool the sintered cylinder bore liner 16 to room temperature. The cool down zone 58 may have a first stage for gradual cool down. The first stage uses cooled air to gradually bring the temperature of the sintered cylinder bore liner 16 down to about 1600° F. The cool down zone 58 may have a second stage for accelerated cool down. The second stage uses a water core (not shown) around the outside of the multi-zone furnace 50 to rapidly bring the temperature of the sintered cylinder bore liner 16 down to about room temperature. It should be appreciated that the first stage may be eliminated if a sinter hardening powder is added to the powder metal mixture. It should also be appreciated that sinter, hardening may be accomplished with the second stage without a sinter hardening powder. It should further appreciated that a length L of the high-heat zone 56 is about equal to that of the cool down zone 58 while the RBO zone 52 is about one third of L and the pre-heat zone 54 is about one half of L.

The final cylinder bore liner 16 must be free of micro-cracks. This condition can be diagnosed through metallographic procedure. The density of the cylinder bore liner 16 should be measured to ensure that uniformity was achieved. A sample should be metallographically prepared and studied under an optical or scanning electron microscope. A uniform grain size is ideal along with isolated, well rounded intermittent pore distribution. If necessary, some ancillary machining may be performed on the cylinder bore liner 16 to produce surface geometry to improve roundness.

Figure 4:
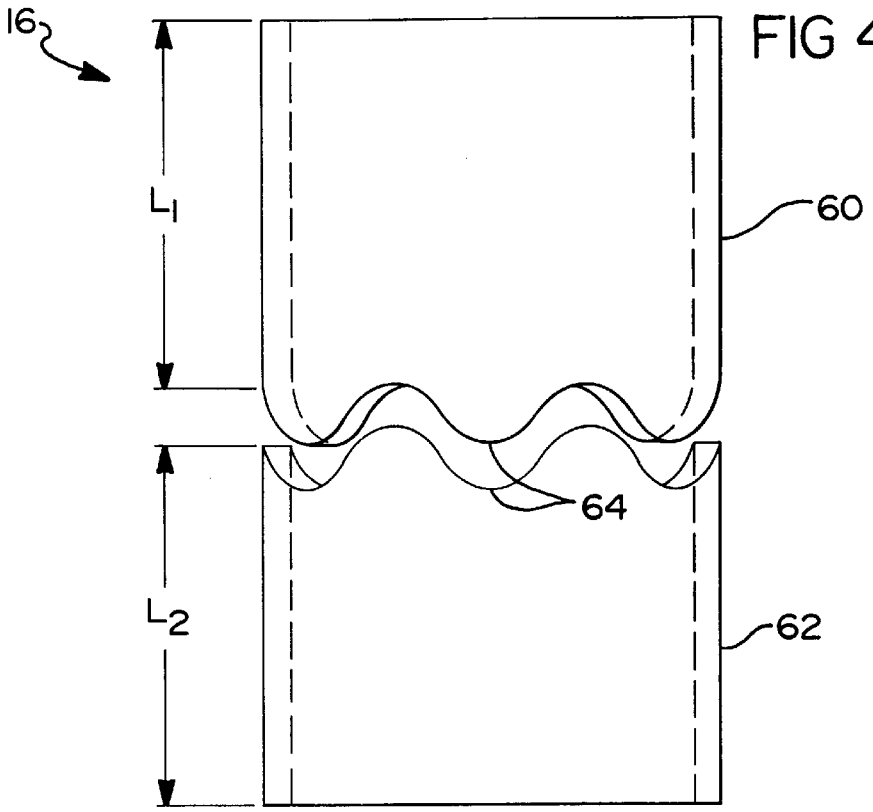
FIG. 4 is an elevational view of another cylinder bore liner produced by another method, according to the present invention.

In another embodiment, the method uses a multiple, preferably two, piece construction to produce a one-piece cylinder bore liner 16. The multiple piece construction allows smaller multi-platen presses such as two hundred tons to be used to impart the necessary pressures to achieve uniform density of the cylinder bore liner 16. As illustrated in FIG. 4, the method includes the step of forming at least a first liner portion 60 and at least a second liner portion 62. The first liner portion 60 has a length $L_1$ and the second liner portion 62 has a length $L_2$. $L_2$ may be of equal or unequal length to the $L_2$. The method also includes the step of forming a predetermined joint interface 64 on the first liner portion 60 and second liner portion 62. The top punch 48 is configured to form a matching predetermined joint interface such as undulating. The method includes the step of compacting as previously described. It should be appreciated that other types of joint interfaces which promote diffusion and represent an aid to diffusion may be used. It should be appreciated that the die 42 produces two briquettes having a joint interface.

The length or sum of $L_1$ plus $L_2$ is about four to five inches while the thickness of the cylinder bore liner 16 is about 0.125 inches. Also, $L_1$ and $L_2$ may be of unequal lengths such that the stroke of the piston 18 lies inside one of the liner portions 60 and 62. Each portion 60 and 62 is compacted to a density of about 6.85 grams/cc.

The powder metal mixture for the first liner portion 60 may be different from that for the second liner portion 62. For example, the powder metal mixture for the first liner portion 60 may have a positive growth and the powder metal mixture for the second liner portion 62 may have a negative growth. The positive and negative growth powders are found in Standard No. 35 previously described.

The method includes the step of assembling the first liner portion 60 and second liner portion 62 together. The first liner portion 60 and second liner portion 62 are designed to achieve mechanical interlocking when assembled in the green state. A clearance between the first liner portion 60 and second liner portion 62 at the joint interface 64, after assembly, must approximate a press fit or at least the intersecting surfaces must make contact with each other at all points. For example, the clearance should be no greater than 0.001 inches. It should be appreciated that this condition is not only necessary for diffusion but is also the prevailing mechanism for diffusion and bonding to occur.

Optionally, a brazing compound may be used at the joint interface 64. The brazing compound may be a powder or paste applied to the joint interface 64 before assembly. The brazing compound melts at a temperature of about 1980° F. It should be appreciated that the brazing compound melts at a temperature lower than that for sintering.

The method also includes sintering the assembled cylinder bore liner 16 and bonding the first liner portion 60 and second liner portion 62 together to form a one-piece cylinder bore liner 16. For sintering similar to that previously described, the assembled first liner portion 60 and second liner portion 62 are placed on a flat plate (not shown) to avoid any motion. The flat plate is made of a stainless steel or refractory material. It should be appreciated that any material such as carbon which can diffuse into the assembled first and second liner portions 60 and 62 should be avoided.

After sintering, the strength of the joint interface 64 can be assessed by: visual observation—there should be no discernable line of separation between two portions; examination of the microstructure after metallographic preparation using an optical or electron microscope; or subjecting the assembled portions 60 and 62 to tensile testing. The strength of the joint interface 64 should be at least as high as the strength of the material. The microstructure should not contain micro-cracks and the pores should be well rounded (indicative of successful sintering) and isolated. The grain boundary should be free of inclusions and voids. In steel or iron cylinder bore liners 16, no decarburization or carburization should be present.

Figure 5:
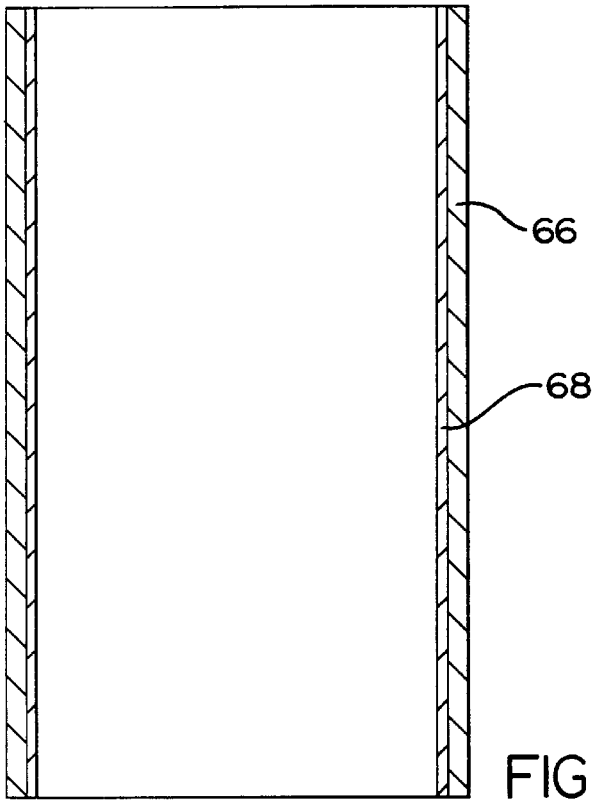
FIG. 5 is an elevational view of yet another cylinder bore liner produced by yet another method, according to the present invention.

In yet another embodiment, the method uses a multiple, preferably two, piece construction to produce a composite cylinder bore liner 16. The method is used for forming at least an outer liner portion 66 and at least an inner liner portion 68 as illustrated in FIG. 5. The method includes forming the outer liner portion 66 of a lightweight material such as aluminum or an aluminum alloy. The method also includes forming the inner liner portion 68 from a wear resistant material such as silicon carbide or steel.

To produce the composite cylinder bore liner 16, the method includes the step of inserting at least one sleeve 70 into the die cavity 40 of the die 42 as illustrated in FIG. 6. The sleeve 70 may be produced from various materials ranging from simple flexible rubber to complex metal composite. The sleeve 70 divides the die cavity 40 into an inner section 72 and outer section 74. The method includes the step of filling the inner section 72 with the wear resistant material and filling the outer portion 74 with the lightweight material. The method includes the steps of withdrawing the sleeve 70 from the die cavity 40. The method includes the steps of compacting and sintering as previously described. For sintering, a vacuum type of multi-zone furnace 50 is used and the high heat zone 56 has a temperature of about 50° F. below the melting point of aluminum. It should be appreciated that the top punch 48 may be used to withdraw and insert the sleeve 70 prior to the steps of filling and compacting. It should also be appreciated that the metallurgical properties of the cylinder bore liner 16 are checked after sintering to make sure bonding has occurred.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method for producing powder metal cylinder bore liners for an internal combustion engine, said method comprising the steps of:

loading a powder metal mixture into a die cavity of a die;

compacting the powder metal mixture in the die cavity using uniaxial pressure from the die and forming the powder metal cylinder bore liner; and sintering the powder metal cylinder bore liner.

2. A method as set forth in claim 1 including the step of ejecting the powder metal cylinder bore liner from the die cavity of the die.

3. A method as set forth in claim 2 wherein said step of ejecting comprises holding a top punch of the die down on the cylinder bore liner and ejecting the powder metal cylinder bore liner in a series of sections.

4. A method as set forth in claim 1 including the step of rapidly burning off any organic lubricants in the cylinder bore liner prior to said step of sintering.

5. A method as set forth in claim 4 including pre-heating the powder metal cylinder bore liner prior to said step of sintering.

6. A method as set forth in claim 1 wherein said step of sintering comprises sintering the powder metal cylinder bore liner between a temperature from about 2050° F. to about 2100° F.

7. A method as set forth in claim 1 including the step of cooling down the sintered powder metal cylinder bore liner.

8. A method as set forth in claim 1 including the step of forming a first liner portion and a second liner portion.

9. A method as set forth in claim 8 including the step of forming a matching joint interface between the first liner portion and second liner portion.

10. A method as set forth in claim 8 including the step of assembling the first liner portion and second liner portion together.

11. A method as set forth in claim 9 including the step of applying a brazing compound to the joint interface.

12. A method as set forth in claim 10 wherein said step of sintering comprises sintering the assembled first liner portion and second liner portion and bonding the first liner portion and second liner portion together.

13. A method as set forth in claim 1 including the step of forming an outer liner portion and an inner liner portion.

14. A method as set forth in claim 13 wherein said step of forming comprising forming the outer liner portion of a lightweight material and the inner liner portion of a wear resistant material.

15. A method as set forth in claim 14 including the step of disposing a sleeve into the die cavity and dividing the die cavity into an inner section and outer section.

16. A method as set forth in claim 15 wherein said step of loading comprises loading the lightweight material into the outer section and loading the wear resistant material into the inner section.

17. A method as set forth in claim 16 including the step of withdrawing the sleeve from the die cavity after said step of loading.

18. A method for producing powder metal cylinder bore liners for an internal combustion engine, said method comprising the steps of:

loading a powder metal mixture into a die cavity of a die;

compacting the powder metal mixture in the die cavity using uniaxial pressure from the die and forming the powder metal cylinder bore liner;

ejecting the powder metal cylinder bore liner from the die cavity of the die by holding a top punch of the die down on the cylinder bore liner and ejecting the powder metal cylinder bore liner in a series of sections; and sintering the powder metal cylinder bore liner.

19. A method for producing powder metal cylinder bore liners for an internal combustion engine, said method comprising the steps of:

loading a powder metal mixture into a die cavity of a die;

compacting the powder metal mixture in the die cavity using uniaxial pressure from the die and forming the powder metal cylinder bore liner in a first liner portion and a second liner portion; and sintering the powder metal cylinder bore liner.

20. A method as set forth in claim 19 wherein said step of forming comprising forming the outer liner portion of a lightweight material and the inner liner portion of a wear resistant material.

* * * * *